US006317915B1

(12) United States Patent
Grearson

(10) Patent No.: US 6,317,915 B1
(45) Date of Patent: Nov. 20, 2001

(54) ENERGY EFFICIENT DECK FRAMING SYSTEM AND METHOD

(75) Inventor: Kenneth R. Grearson, Park Ridge, IL (US)

(73) Assignee: Multuloc International Systems, Park Ridge, IL (US)

( * ) Notice: Subject to any disclaimer, the term of this patent is extended or adjusted under 35 U.S.C. 154(b) by 0 days.

(21) Appl. No.: 09/430,494

(22) Filed: Oct. 29, 1999

Related U.S. Application Data

(60) Provisional application No. 60/106,453, filed on Oct. 30, 1998.

(51) Int. Cl.[7] ..... E01D 19/12

(52) U.S. Cl. ..... 14/73; 14/73.1; 52/126.5; 52/126.7; 249/23; 249/24; 249/211; 249/25

(58) Field of Search ..... 14/73, 73.1; 404/47, 404/53, 56, 48; 52/506.07, 126.5, 126.7; 249/23, 24, 25, 211

(56) References Cited

U.S. PATENT DOCUMENTS

| | | | | |
|---|---|---|---|---|
| 4,599,831 | * | 7/1986 | Magaha, Jr. | 52/506.07 |
| 4,733,509 | * | 3/1988 | Takahashi | 52/126.5 |
| 5,092,559 | * | 3/1992 | Tjelle | 249/211 |
| 5,241,798 | * | 9/1993 | Platt et al. | 52/506.07 |
| 5,311,629 | * | 5/1994 | Smith | 14/73.1 |
| 5,359,826 | * | 11/1994 | Grearson | 52/650.1 |
| 5,603,193 | * | 2/1997 | Koertge et al. | 52/506.07 |
| 5,720,067 | | 2/1998 | Grearson . | |

OTHER PUBLICATIONS

*Metl–Span III CF Polyurethane Insulated Panels; Pioneering Foam Panel Technology*, Metl–Span Corporation Brochure, 07410/MET Buyline 7344, 1995.

*Pioneering Foam Panel Technology*, Metl–Span Corporation Brochure and spec sheets, 1996.

*UNISTRUT Metal Framing, General Engineering Catalog*, Unistrut Corporation, North American Edition No. 12.

* cited by examiner

*Primary Examiner*—Thomas B. Will
*Assistant Examiner*—Alexandra K. Pechhold
(74) *Attorney, Agent, or Firm*—Pauley Petersen Kinne & Fejer

(57) ABSTRACT

An energy efficient deck framing system and method is disclosed. In a deck framing system having structural framing members that support a deck panel structure, individual deck panels are inserted between pairs of the framing members. Supporting rods extend downward through the top of the framing members and are provided with a support nut that is sized to maintain the framing member in a supported fashion. An insulating subassembly is provided having an insulating washer interposed between a conventional washer or a secondary nut and the top of the framing member, and an insulating retainer clip received in the lower portion of the top of the framing member and the support nut. The insulating retainer clip is constructed and arranged to be securably received within the contours of the framing member. The retainer clip can either be constructed and arranged to be releasably mountable on the support nut or it can be constructed and arranged to more uniformly distribute the load transmitted by the support rods to the framing member.

9 Claims, 13 Drawing Sheets

ENERGY EFFICIENT DECK FRAMING SYSTEM AND METHOD

This application claims benefit of Prov. No. 60/106,453 filed Oct. 30, 1998.

BACKGROUND OF THE INVENTION

1. Field of the Invention

This invention relates to an energy efficient deck framing system and method for installing the system wherein prefabricated deck panel structures can be quickly and efficiently brought to a working location and positioned into place in such a way as to minimize the loss of thermal energy through the supporting structure of the system.

2. Description of Prior Art and of U.S. Pat. No. 5,720,067

The inventor hereof has already contributed to the art of systems and methods for installing deck framing, as evidenced by U.S. Pat. No. 5,720,067, incorporated herein by reference. This patent teaches much about the prior art preceding U.S. Pat. No. 5,720,067 in its description of the prior art section.

In addition to the prior art, U.S. Pat. No. 5,720,067 itself teaches the use of one or more deck panels which can be secured with respect to and between two elongated structural framing members to form a deck panel structure. The deck panel structure is then positioned between two primary structural members in a position such that each structural framing member is suspended from a support arm or a support structure that is supported by a corresponding one of the primary structural members. In this embodiment, at least each corner portion of the deck panel structure can be mechanically adjusted to vary a vertical position of the deck panel structure.

Prior to the invention of U.S. Pat. No. 5,720,067, many deck structures had been supported by an angle bracket having one leg structurally welded to an edge portion or an underside of a horizontal flange of a steel stringer, a steel plate, a girder, or another suitable steel primary structural member. Deck pans or other suitable deck panels of these deck structures were individually positioned between opposing angle brackets which were welded into place in the field. Each deck pan was positioned upon horizontal flanges of such field-installed opposing angle brackets. The deck pan was then secured with a sheet metal screw or a weld, also at the job site.

With these deck framing systems, each vertical height adjustment to vary the elevation of the top of the deck pan required labor-intensive field adjustments, often accomplished with welded connections. Furthermore, many of these deck framing systems had welded connections or metal fasteners exposed beneath the deck structure.

Furthermore, deck framing systems of the prior art, and even those disclosed in U.S. Pat. No. 5,720,067, tend to be constructed of metal. Especially when used to support a ceiling of a cold room, a walk-in refrigerator, or any other situations where heat transfer between the space above and the space below the deck panels is disadvantageous, metal-to-metal heat transfer can result in energy inefficiencies.

Thus, a problem associated with deck framing systems and methods therefor that precede the present invention is that they do not provide a thermally insulated mechanical deck structure support that substantially prevents thermal conductivity of energy along the metal supports thereof.

Yet another problem associated with deck framing systems and methods therefor that precede the present invention is that they do not facilitate quick installation of the deck panels by permitting pre-placement of the securement means prior to installation of the deck panels, and movement of the securement means as the deck panels are installed.

Still a further problem associated with deck framing systems and methods therefor that precede the present invention is that they do not facilitate efficient transportation to a job site in a manner that saves shipping space and thereby saves time, energy and money.

Yet an additional problem associated with deck framing systems and methods therefor that precede the present invention is that they do not enable efficient assembly and erection of the deck framing system.

Another problem associated with deck framing systems and methods therefor that precede the present invention is that they do not permit utilization of multi-sized prefabricated deck panel structures which can be positioned directly upon horizontal flanges of more uniform steel stringers or other primary structural support members that do not need to be specifically sized in advance to correspond to the thickness of the prefabricated deck panel structures.

Still a further problem associated with deck framing systems and methods therefor that precede the present invention is that the vertical height of each deck panel structure cannot be quickly adjusted using simple mechanical elements to accommodate the varying dimensional characteristics of the prefabricated deck panel structures.

For the foregoing reasons, there has been defined a long felt and unsolved need for an energy efficient deck framing system and method that is easily installed, inexpensive to manufacture and adjustable to accommodate a variety of prefabricated parts of differing sizes and dimensions.

In contrast to the foregoing, the present invention constitutes an energy efficient deck framing system and method that seeks to overcome the problems discussed above, while at the same time providing a simple, easily constructed apparatus and method that is readily adapted to a variety of applications.

SUMMARY OF THE INVENTION

It is an object of the present invention to provide a deck framing system and method that provides a means of insulating the metal deck structure to substantially reduce the loss of thermal energy through thermal conductivity within the deck support structure.

Still another object of the present invention is to provide a deck framing system and method that provides a thermally insulated mechanical deck structure support that substantially prevents thermal conductivity of energy along the metal supports thereof.

Yet another object of the present invention is to provide a deck framing system and method that facilitates quick installation of the deck panels by permitting pre-placement of the securement means prior to installation of the deck panels, and movement of the securement means as the deck panels are installed.

Another object of the present invention is to provide a deck framing system and method that facilitates efficient transportation to a job site in a manner that saves shipping space and thereby saves time, energy and money.

Still a further object of the present invention is to provide a deck framing system and method that facilitates efficient assembly and erection of the deck framing system.

Yet another object of the present invention is to provide a deck framing system and method that permits utilization of multi-sized prefabricated deck panel structures which can be positioned directly upon horizontal flanges of more uniform steel stringers or other primary structural support members that do not need to be specifically sized in advance to correspond to the thickness of the prefabricated deck panel structures.

An even further object of the present invention is to provide a deck framing system and method that permits the vertical height of each deck panel structure to be quickly adjusted using simple mechanical elements to accommodate the varying dimensional characteristics of the prefabricated deck panel structures.

Still a further object of this invention is to provide a deck framing system which accommodates prefabricated deck panels that can be quickly positioned into place between two structural framing members.

It is another object of this invention to provide a deck framing system wherein the deck panels are directly supported on the structural framing members, without requiring structural welds between the horizontal flange of the structural framing member and any component of the deck panel structure, and where means for securing the deck panels in place can be attached to the deck panel support structures before the stringers are installed into place.

Thus, the present invention is an energy efficient deck framing system and method directed to minimizing the energy consumed during shipment, installation and operation of a structure utilizing a deck framing system. In a deck framing system having structural framing members that support a deck panel structure, individual deck panels are inserted between pairs of the framing members. Supporting rods extend downward through the top of the framing members and are provided with a support nut that is sized to maintain the framing member in a supported fashion. An insulating subassembly is provided having an insulating washer interposed between a conventional washer or a secondary nut and the top of the framing member, and an insulating retainer clip in the lower portion of the top of the framing member and the support nut. The insulating retainer clip is constructed and arranged to be securably received within the contours of the framing member and is also constructed and arranged to be releasably mountable on the support nut. In another embodiment of the invention, a T-shaped splice plate is used to secure the deck panels into place with respect to the framing members. Pre-installation of the splice plates is facilitated by selectively rotating the splice plate during insertion of the deck panels, such that the splice plates can be pre-installed and yet not interfere with insertion of the deck panels. In a third embodiment of the present invention, an energy saving shipping method is provided. Structural framing members are positioned in alternate, upside-down, interlocking relation to one another, such that the horizontal flange of an upside down member rests on the top of an adjacent, interlocking member. The rods are then positioned inside the hollow space of the members for shipping. In yet another embodiment of the invention, a sizing bracket has a top having a width sized to accommodate the width of the structural framing member. The top is provided with a bore receiving aperture to receive the supporting rod therethrough. Sides of the bracket are generally sized to accommodate the thickness of the deck panel. The dimensions of these sides need not be precise, as judicious placement of the secondary nut and the splice plate nut permit a single sizing bracket to be adaptable to a variety of thicknesses of deck panels.

These and other objects, advantages and features of the present invention will be apparent from the detailed description that follows.

BRIEF DESCRIPTION OF THE DRAWINGS

In the detailed description that follows, reference will be made to the following figures:

FIG. 2(*b*) illustrates a perspective view illustrating a second structural framing member with which the energy efficient deck framing system and method can be adapted;

FIG. 9(*b*) illustrates an end plan view of still another preferred embodiment of the energy efficient deck framing system and method;

DETAILED DESCRIPTION OF THE PREFERRED EMBODIMENTS

Figure 1:
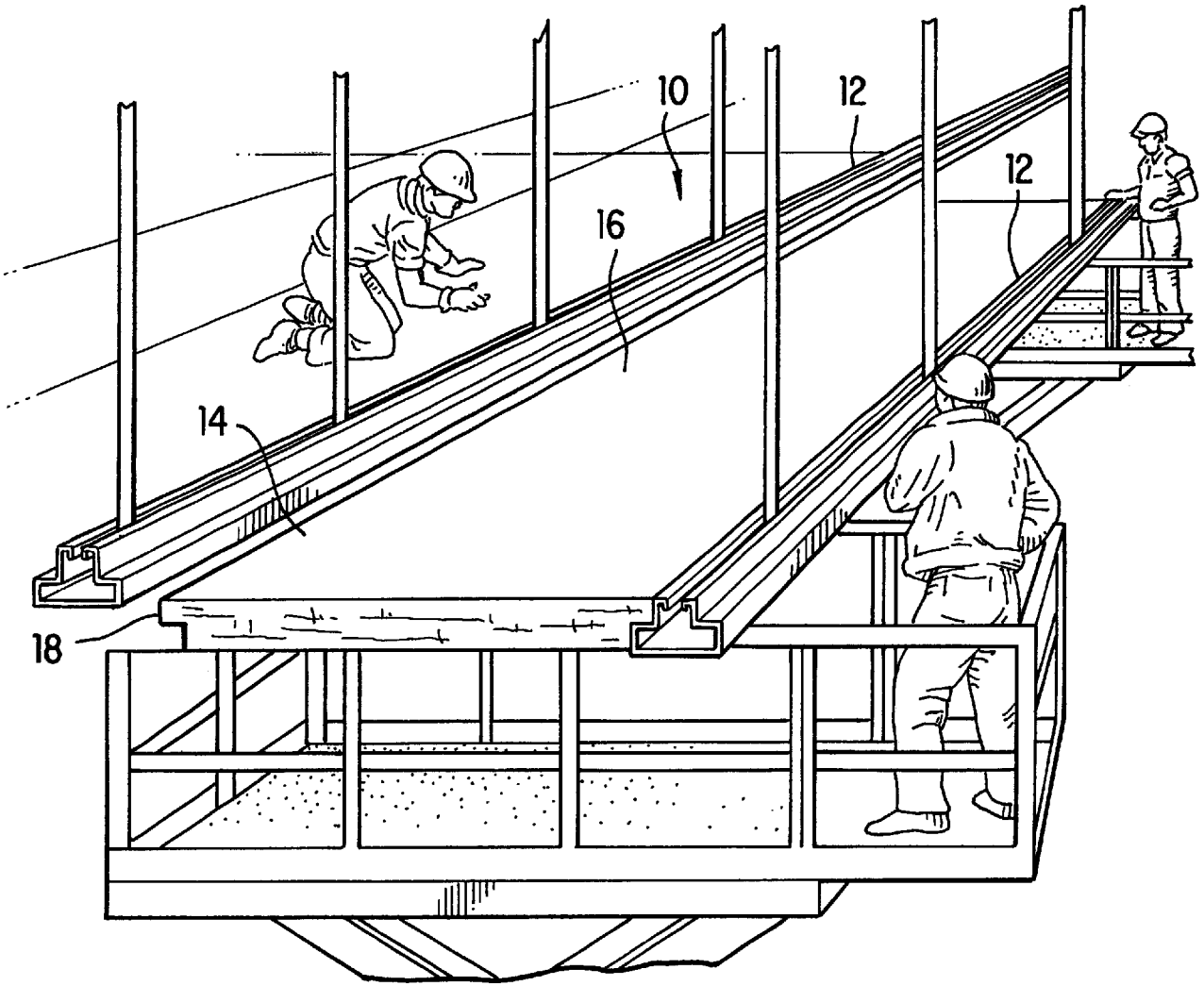
FIG. 1 illustrates an upper, perspective view illustrating a preferred embodiment of the energy efficient deck framing system and method.

FIG. 1 shows a deck framing system 10 having structural framing members 12 that support deck panel structures 14. The deck panel structures 14 are made up of deck panels 16 each having deck panel edge portions 18.

FIG. 1 shows a partial front view of a typical installation according to deck framing system 10 of this invention, and shows a schematic top view of deck panel structure 14 according to one preferred embodiment of this invention. When prefabricated, deck panel structure 14 may comprise approximately ten deck panels 16, and may be sized about 8 feet wide by about 20 feet long, for example. It is apparent that, depending upon the particular use and design, each deck panel structure 14 may comprise more or less than ten deck panels 16.

As adapted in the preferred embodiments, the deck framing system 10 and method shown herein can be adapted for suspending an insulated ceiling over a cold room, a walk-in refrigerator, or any other situation in which it is desired to reduce the heat transfer between the space below the panels 16 and the space above the panels 16.

As shown in FIG. 1, deck panel structure 14 comprises one or more deck panels 16 positioned between and supported by two structural framing members 12 positioned on opposite sides of deck panel 16. In one preferred embodiment of this invention, deck panel 16 is positioned upon horizontal flange 24 of structural framing member 12.

Deck panel 16 can be secured with respect to structural framing member 12 by a welded connection or by any other suitable mechanical connection means known to those skilled in the art, such as screw fasteners or the like. Any suitable means for supporting deck panel 16 with respect to structural framing member 12 can be used to secure the edge portion 18 of deck panel 16 with respect to horizontal flange 24 or any other suitable structural component of structural framing member 12. However, as seen below and in FIGS. 6, 7 and 8, one embodiment of the energy efficient deck framing system and method of the present invention facilitates securement means of a different type.

Referring now again to FIG. 1, the structural framing members 12 may comprise square tubing and may be U-shaped. At present, these can be manufactured by Unistrut Corporation, in Wayne, Michigan. Any other suitable structural member that is relatively strong and relatively lightweight can be used, however.

Figure 2A:
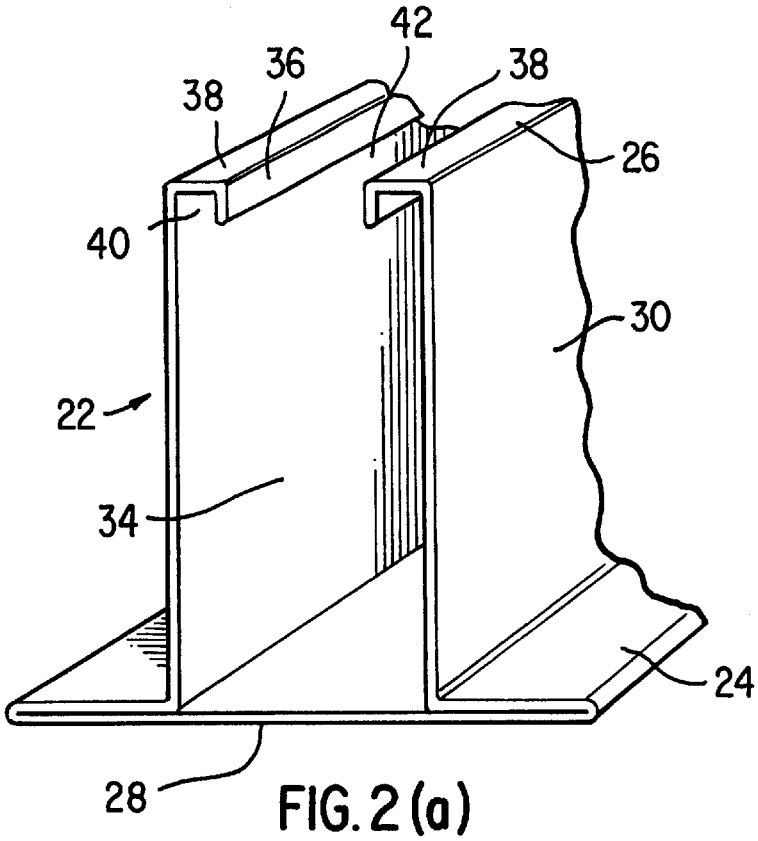
FIG. 2(*a*) illustrates a perspective view illustrating a first structural framing member with which the energy efficient deck framing system and method can be adapted.
Figure 2B:
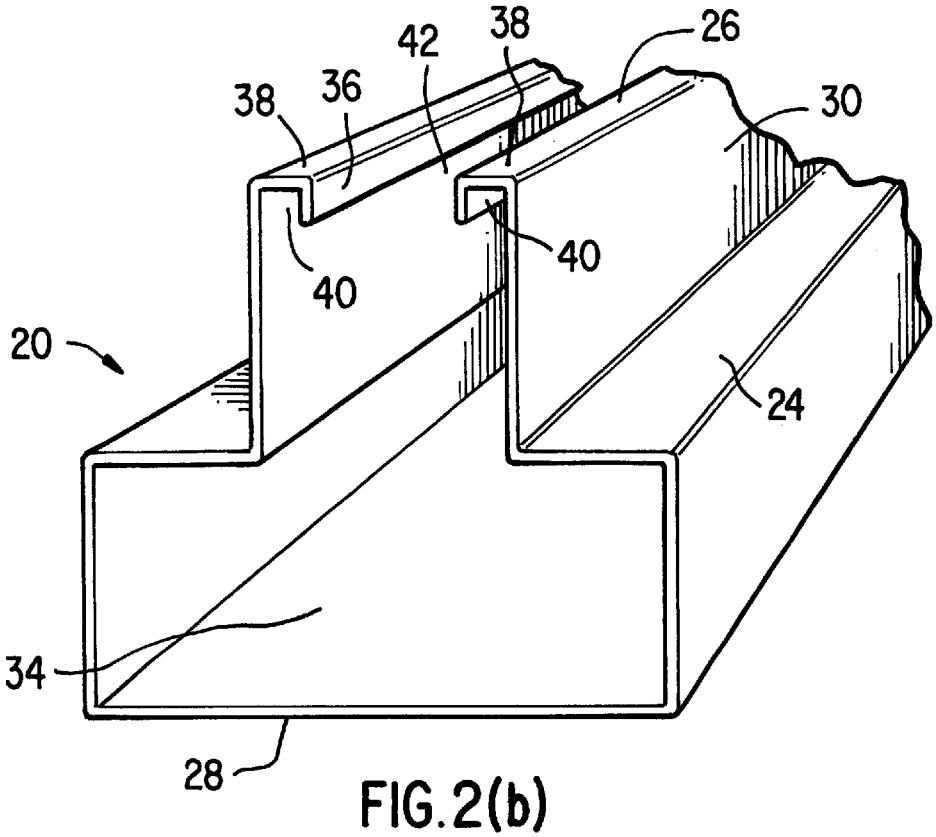

Referring now to FIG. 2, two (2) embodiments of the structural framing members 12 are shown. In FIG. 2(*a*), a normal load-bearing structural framing member 22 is shown. In FIG. 2(*b*), a heavy load-bearing structural framing member 20 is shown.

As still further shown in FIGS. 2(*a*) and 2(*b*), each of the structural framing members 20, 22 has a pair of horizontal flanges 24, a top 26 and a flat bottom 28. The side wall 30 connects the horizontal flanges 24 with the top 26. To minimize weight, a hollow space 34 is provided in the structural framing members 20, 22. Proximate to the top 26 of the framing members is a pair of inwardly facing vertical surfaces 36. The top 26 of the structural framing members 20, 22 each are provided a top flat outer ridge 38. As constructed and arranged, the top flat outer ridge 38, the inwardly facing vertical surface 36, and a portion of the side wall 30 define a downwardly oriented groove 40. Spacing between the boundaries of the inwardly facing vertical surfaces 36 provide an opening 42 through which a supporting rod (not shown) can be extended.

Figure 3:
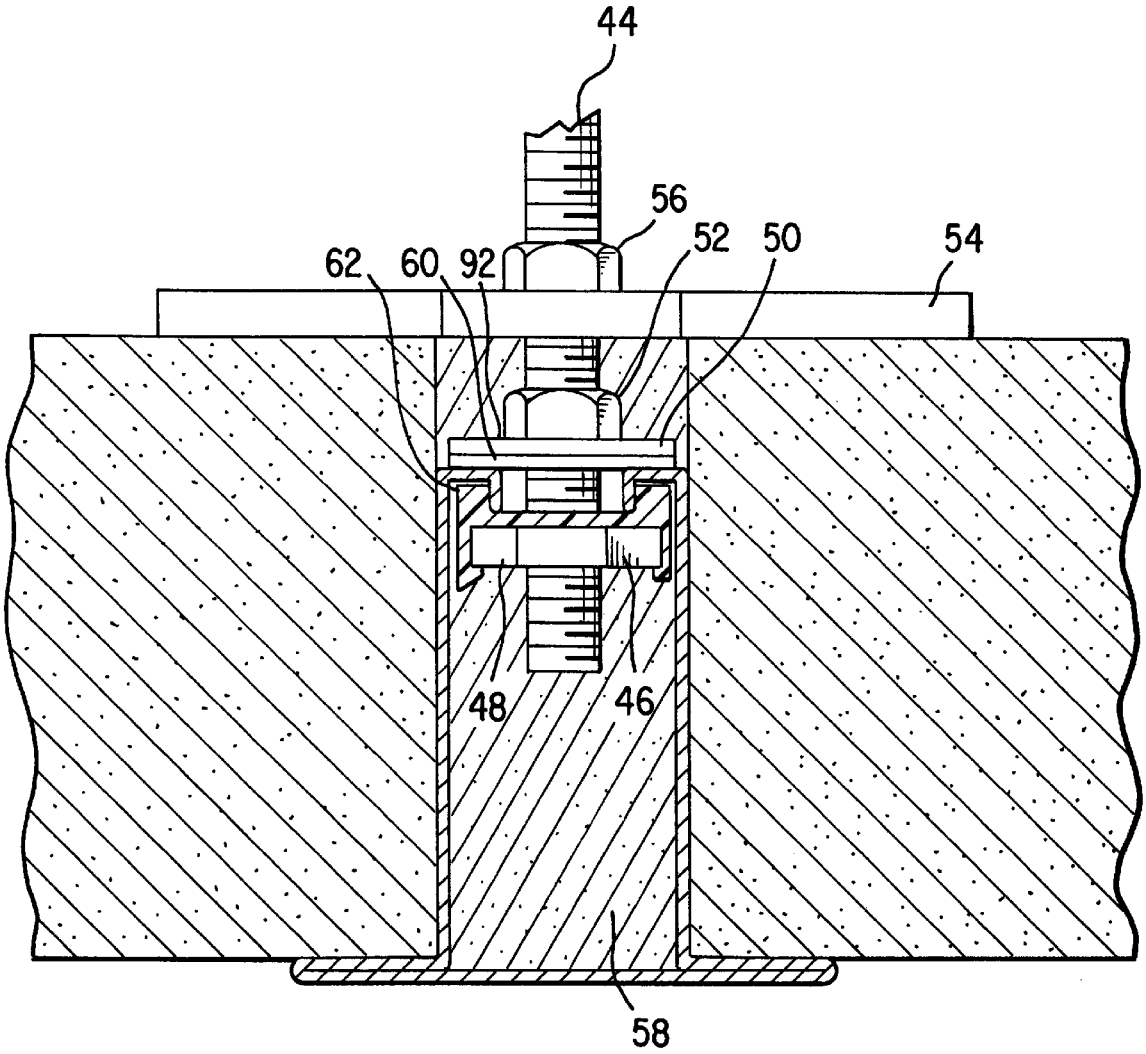
FIG. 3 illustrates a side cut-away view of a first embodiment of the energy efficient deck framing system.

Referring now to FIG. 3, the assembly of the deck framing system 10 is shown. A supporting rod 44 extends downward from a surface from which the deck framing system is to be suspended. A support nut 48 is provided on the supporting rod 44 and is sized to prevent the framing member 12 from moving downward away from the supporting rod 44 more than a pre-determined amount.

A secondary nut 52 is provided on the opposite side of the conventional washer 50 from the support nut 48 so as to permit tightening of the washer 50 against the structural framing member 12 in such a way as to hold the assembly in place. A splice plate 54 is provided above the deck panel structure 14 so as to secure the deck panels 16 in place. The splice plate 54 is held in place by a splice plate nut 56 which is disposed above the splice plate 54 in relation to the retainer clip 62.

Further as shown in FIG. 3, an insulating subassembly 92 is shown.

The insulating subassembly 92 comprises an insulating washer 60 and an insulating retainer clip 62. These are preferably made of nylon or plastic, or of any other insulating material (i.e., having a low heat transfer coefficient) with sufficient strength and flexibility.

The insulating washer 60 is disposed between the conventional washer 50 and the top portion of the structural framing member 12. This prevents thermal communication through conductivity of the metal-on-metal contact that would otherwise exist as between the structural framing member 12 and the conventional washer 50. Because the conventional washer 50 is in thermal communication with the secondary nut 52 and/or the supporting rod 44, thermal communication between the structural framing member 12 and the conventional washer 50 would enable the communication of energy from a space below the flat bottom 28 of the structural framing member 12 and the space above the splice plate 54. Accordingly, placement of the insulating washer 60 substantially reduces the thermal conductivity therebetween.

Likewise, the insulating retainer clip 62 is disposed between the support nut 48 and the top portion of the structural framing member 12. This prevents thermal communication through conductivity of the metal-on-metal contact that would otherwise exist as between the structural framing member 12 and the support nut 48. Because the support nut 48 is in thermal communication with the supporting rod 44, thermal communication between the structural framing member 12 and the support nut 48 would also enable the communication of energy from a space below the flat bottom 28 of the structural framing member 12 and the space above the splice plate 54. Accordingly, placement of the insulating retainer clip 60 further substantially reduces the thermal conductivity therebetween.

To further provide for thermal insulation between the space below the flat bottom 28 of the structural framing member 12 and the space above the splice plate 54, insulation can be blown into the space 34 in the structural framing member 12.

Figure 4:
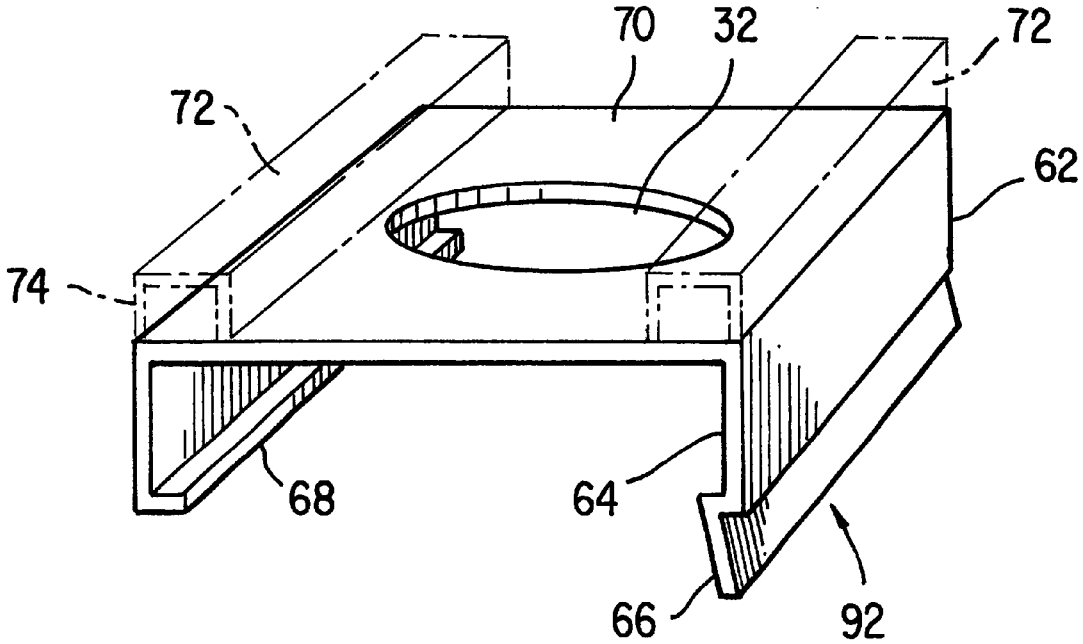
FIG. 4 illustrates a perspective view of a preferred embodiment of the insulating apparatus showing an insulating retainer clip and an insulating washer adapted for use with the energy efficient deck framing system and method.
Figure 4:
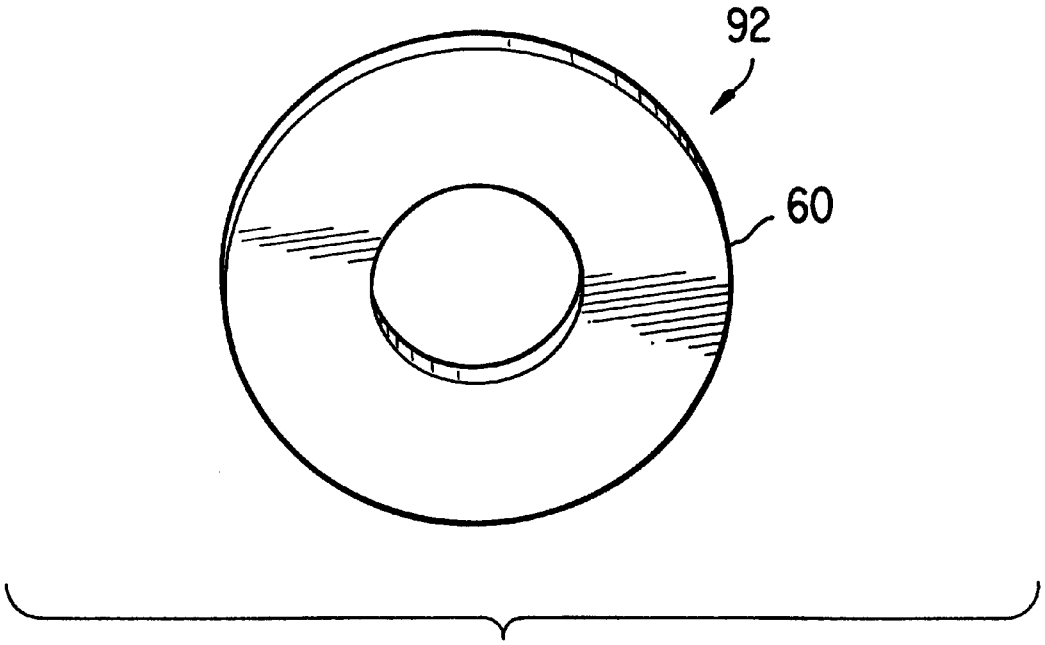
Figure 5:
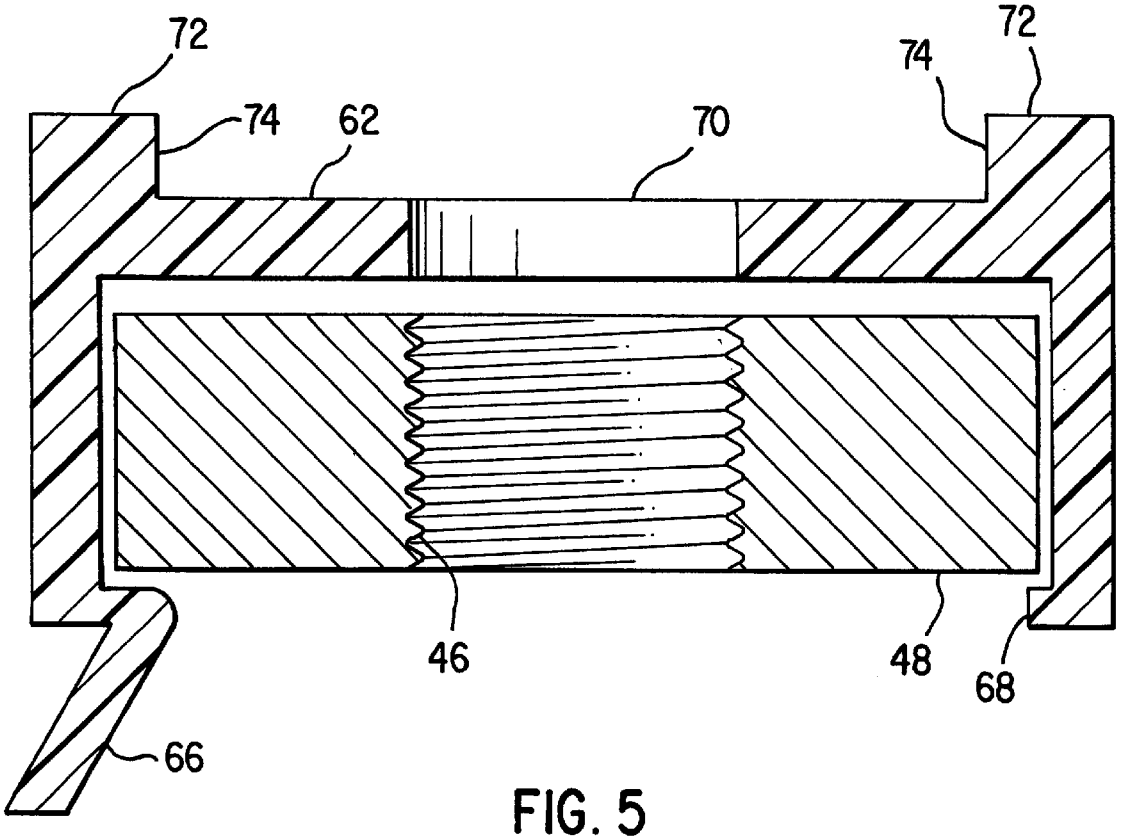
FIG. 5 illustrates a side cut-away view of the insulating retainer clip shown in FIG. 4.

Referring now to FIGS. 4 and 5, the structure of the insulating retainer clip 62 is shown in more detail. The insulating retainer clip 62 is provided with a nut-receiving recess 64 (shown in FIG. 4) and is adapted for receiving a support nut 48 (shown in FIG. 5).

Preferably, the retainer clip 62 is made of material that is slightly deformable so that it can be easily installed and removed without the use of excessive force or special tools. The insulating retainer clip 62 is provided with a releasable tab 66 and a retaining tab 68. As constructed and arranged, the retaining tab 68 extends horizontally inward from the sides of the retaining clip 62. The releasable tab 66 permits manual deformation of the retainer clip 62 between a non-deformed position and a deformed position for installation and removal thereof. The clip 62 is in substantially the non-deformed position when it is properly fitted on the nut 48. The clip 62 is in the deformed position when it is either being removed or installed.

The innermost dimensions of the retaining tab 68 and the releasable tab 66 are sized that, in the non-deformed position, the distance therebetween is less than the working diameter of the support nut 48 and that, in the deformed position, the distance therebetween is greater than the working diameter of the support nut 48. Thus, the retainer clip 62 can be affixed over a support nut 48, and by virtue of its deformation when subject to an outward pressure on the release tab 66, the retaining clip 62 is removable from the support nut 48.

As further shown in FIGS. 4 and 5, the insulating retainer clip 62 is provided with a top depressed surface 70 and top ridges 72 (more clearly shown in FIG. 5). The top ridges 72 are disposed outwardly from the top depressed surface 70 and define upwardly oriented tongues 74. As described above, the upwardly oriented tongues 74 are sized to be received within the downwardly oriented grooves 40 of the structural framing members 12 such that the retaining clip 62 is securably receivable within the contours of the structural framing member 12.

Figure 6:
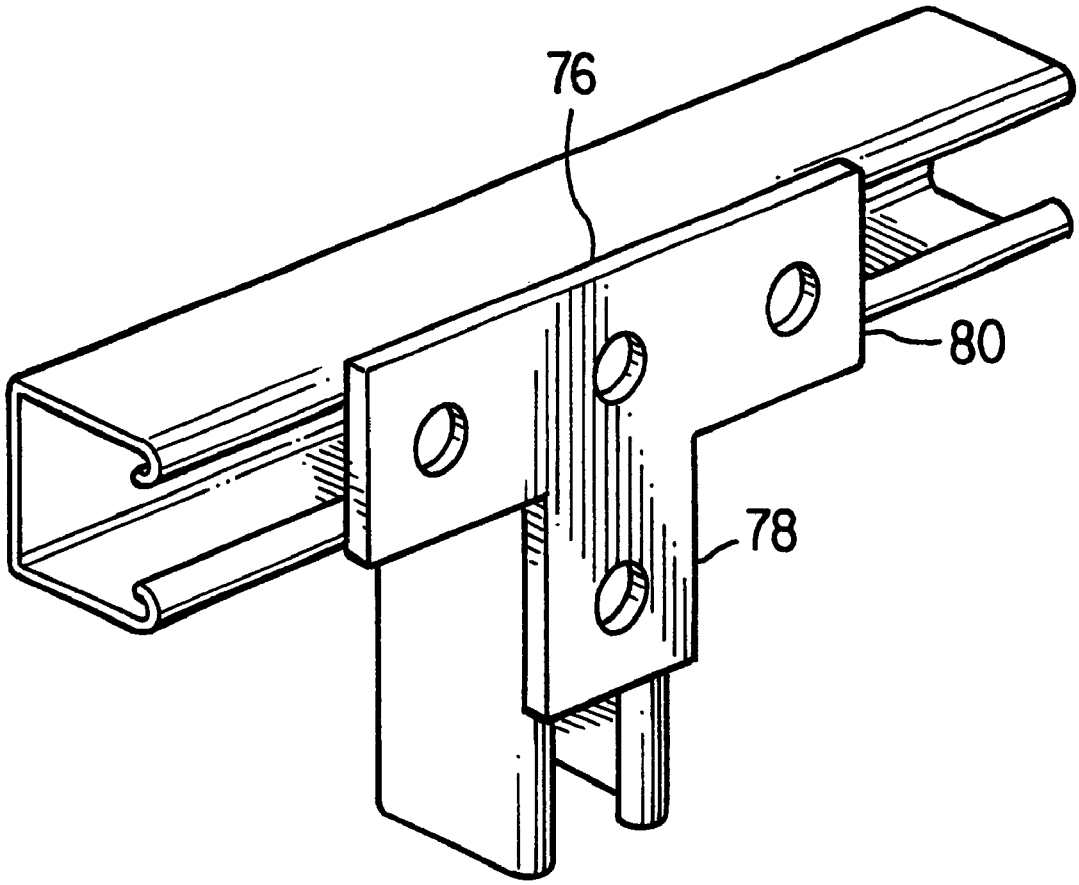
FIG. 6 illustrates a side perspective view of another preferred embodiment of the energy efficient deck framing system and method.
Figure 7:
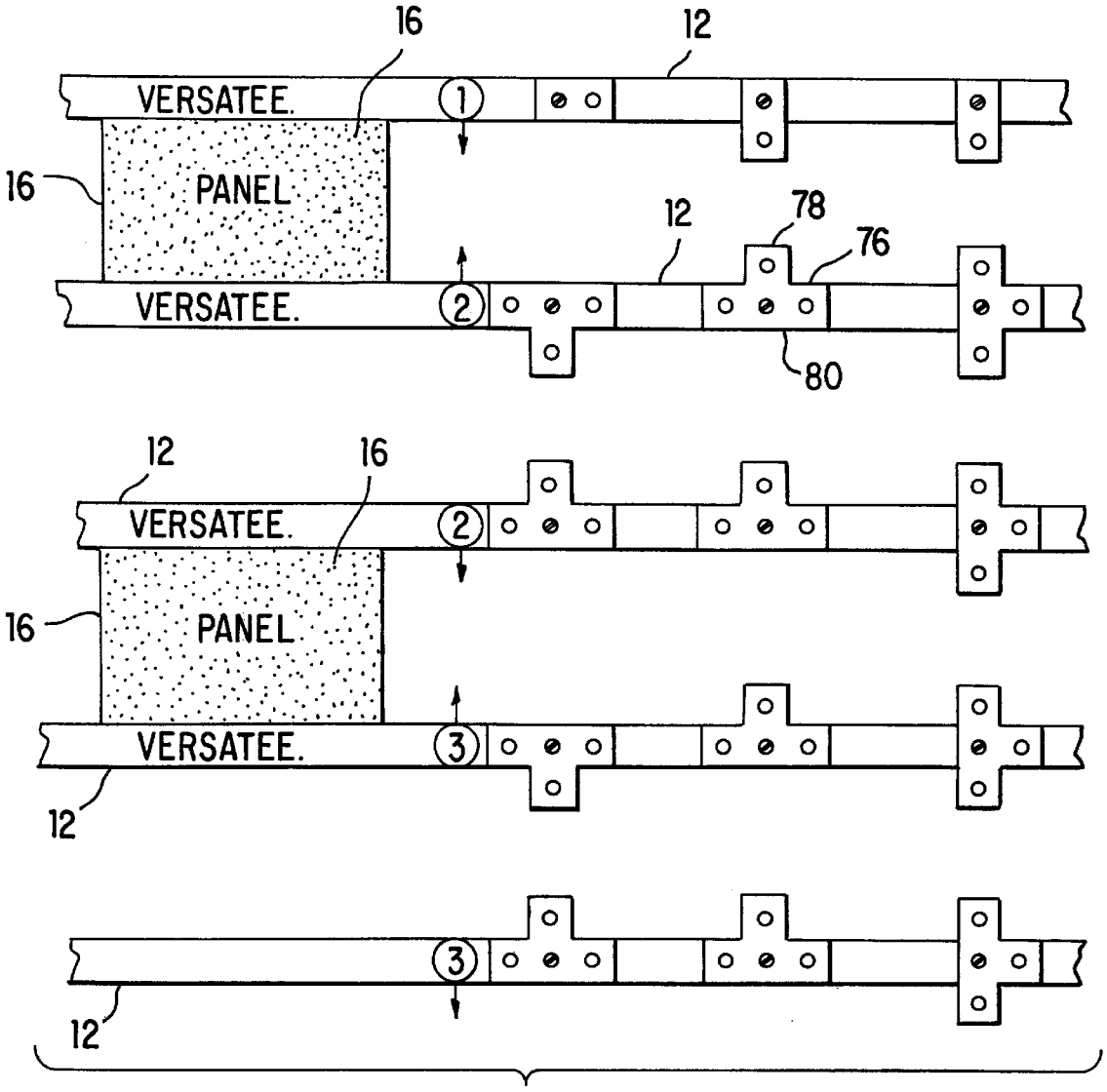
FIG. 7 illustrates a top plan view of the energy efficient deck framing system and method shown in FIG. 6.
Figure 8:
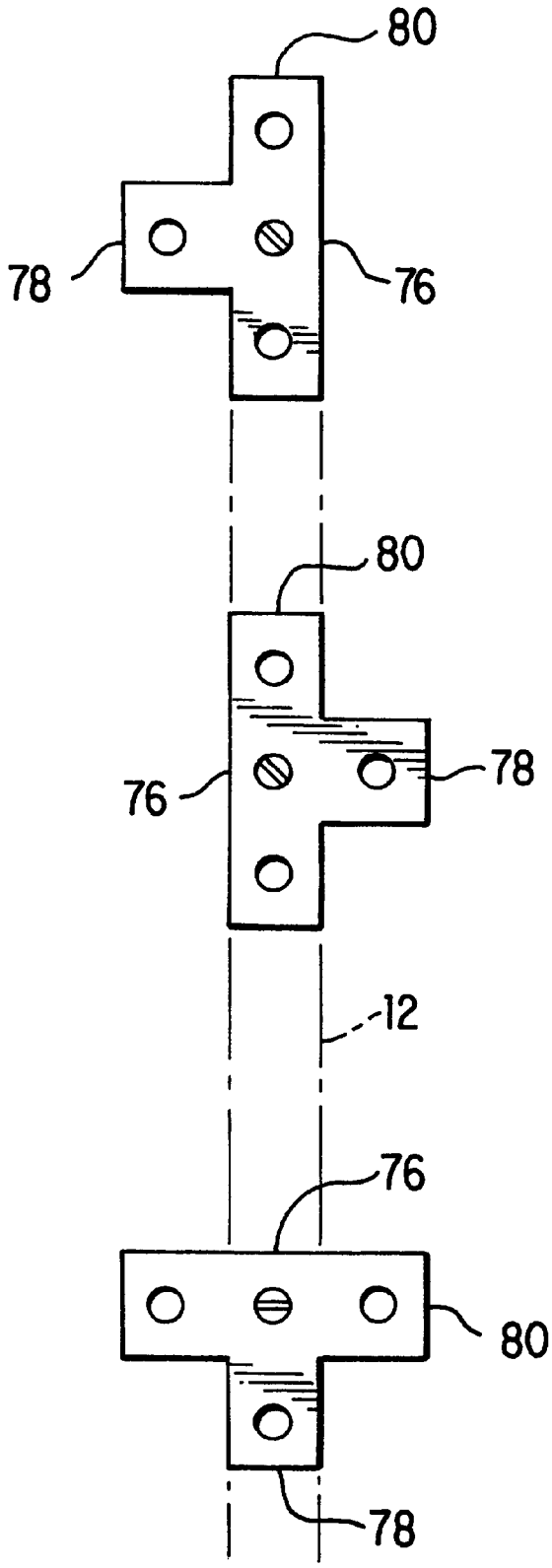
FIG. 8 illustrates a top plan view of the energy efficient deck framing system and method shown in FIG. 7.

Referring now to FIGS. 6–8, yet a further embodiment of the invention is disclosed illustrating a method of selectively placing and securing the deck panels 16 in the deck framing system 10.

As shown in FIG. 6, a T-shaped splice plate 76 comprises a bottom section 78 and a top bar 80. Referring now to FIG. 7, the structural framing members 12 are illustrated in a fashion in which they receive the deck panels 16. The preferred embodiment described herein enables a method of inserting the deck panel 16 such that the T-shaped splice plates 76 can be put in place on the structural framing members 12 prior to installation of the deck panel 16. As shown in FIG. 7, and in singular fashion in FIG. 8, the deck panels 16 are inserted as follows.

First, the T-shaped splice plate 76 is rotated such that the top bar 80 overlays the structural framing member 12 and the bottom section 78 is oriented away from the deck panel 16 to be inserted. Thus, the deck panel 16 can be inserted between the structural framing members 12 without interference from the T-shaped splice plate 76. Once the deck panels 16 have been inserted into a row between two (2) structural framing members 12, the T-shaped splice plates are rotated 180° such that the bottom section 78 is now located over a portion of the deck panel 16 and the top bar 80 of the T-shaped splice plate 76 again overlays the structural framing member 12. Insertion of deck panels 16 on the other side of the structural framing member 12 is now performed in similar fashion.

Once all of the panels 16 have been installed on both sides of the structural framing member 12, the T-shaped splice plate 76 is rotated 90° such that the bottom section 78 overlays the structural framing member 12 and the top bar 80 is disposed perpendicularly to the top to the structural framing member 12, such that a portion of the top bar 80 is located over each of the two deck panels 16. The T-shaped splice plate 76 is then secured in place with bolts (not shown) so that the deck panels 16 are secured in place with respect to the structural framing members 12, thereby providing means for securing the deck panels 16 in fixed relation to the framing member 12.

Figure 9A:
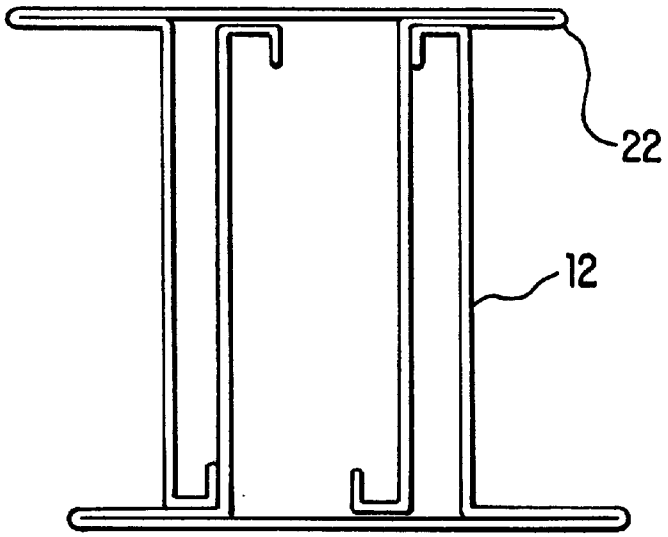
FIG. 9(*a*) illustrates an end plan view of yet another preferred embodiment of the energy efficient deck framing system and method.
Figure 9B:
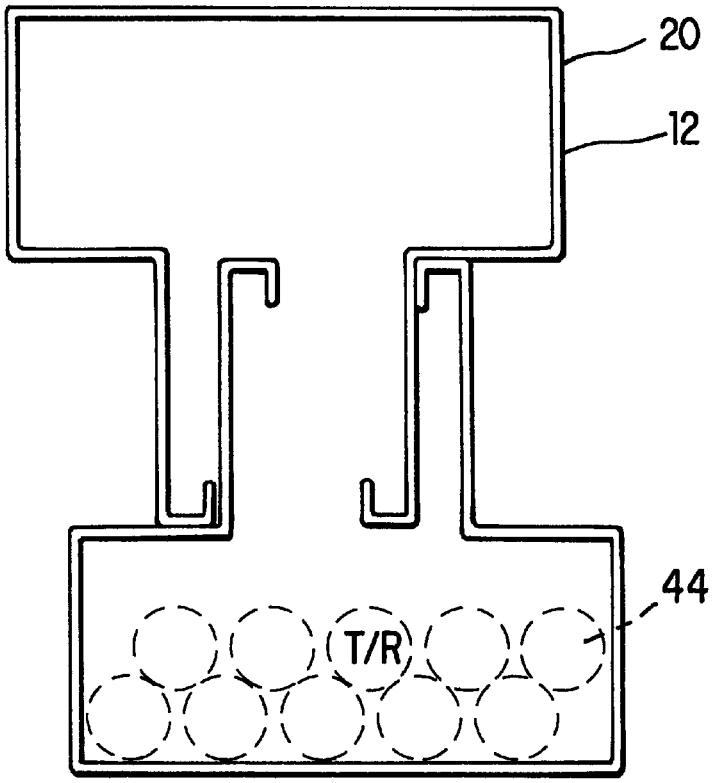

Referring now to FIG. 9, yet another preferred embodiment of the energy efficient deck framing system and method is shown. In this embodiment, a method of packing and shipping structural framing members 12 and the supporting rods 44 is shown. To practice this method, structural framing members 12 are positioned in alternate, upside-down, interlocking relation to one another, such that the horizontal flange 24 of an upside-down member 12 rests on the top 26 of an adjacent, interlocking member 12. The rods 44 are then positioned inside the hollow space 34 of the members 12 for shipping. FIG. 9(*a*) shows the above packing and shipping method adapted to a normal load bearing structural framing member 22. FIG. 9(*b*) shows the above packing and shipping method adapted to a heavy load bearing structural framing member 20.

Figure 10:
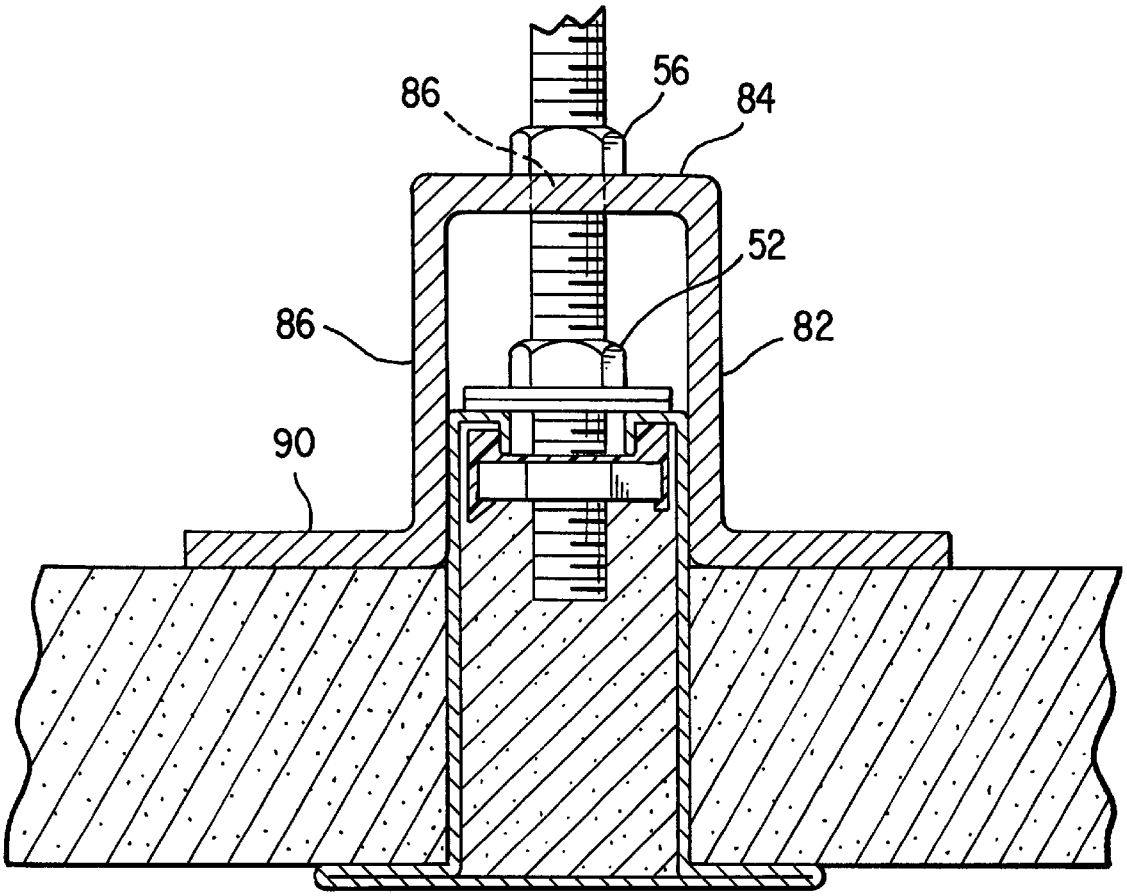
FIG. 10 illustrates a side cut-away view of yet another embodiment of the energy efficient deck framing system and method.

In still another embodiment of the energy efficient deck framing system and method, shown in FIG. 10, a sizing bracket 82 is illustrated. The sizing bracket 82 permits the energy efficient deck framing system and method to be adapted to a variety of thicknesses of deck panels 16, by providing an alternative structure to the flat splice plate 76 for accommodating varying thicknesses of deck panel 16.

Thus, as shown, the sizing bracket 82 has a top 84 having a width sized to accommodate the width of the structural framing member 12. The top 84 is provided with a bore receiving aperture 86 to receive the supporting rod 44 therethrough. Sides 88 of the bracket 82 are generally sized to accommodate the thickness of the deck panel 16. The dimensions of these sides 88 need not be precise, as judicious placement of the secondary nut 52 and the splice plate nut 56 permit a single sizing bracket 82 to be adaptable to a variety of thicknesses of deck panels 16. Finally, the sizing bracket 82 is provided with horizontally extending base legs 90 to receive and distribute a force along the deck panels 16 to secure them in place with respect to the structural framing members 12 without crushing, deforming or damaging the deck panels 16.

Figure 11:
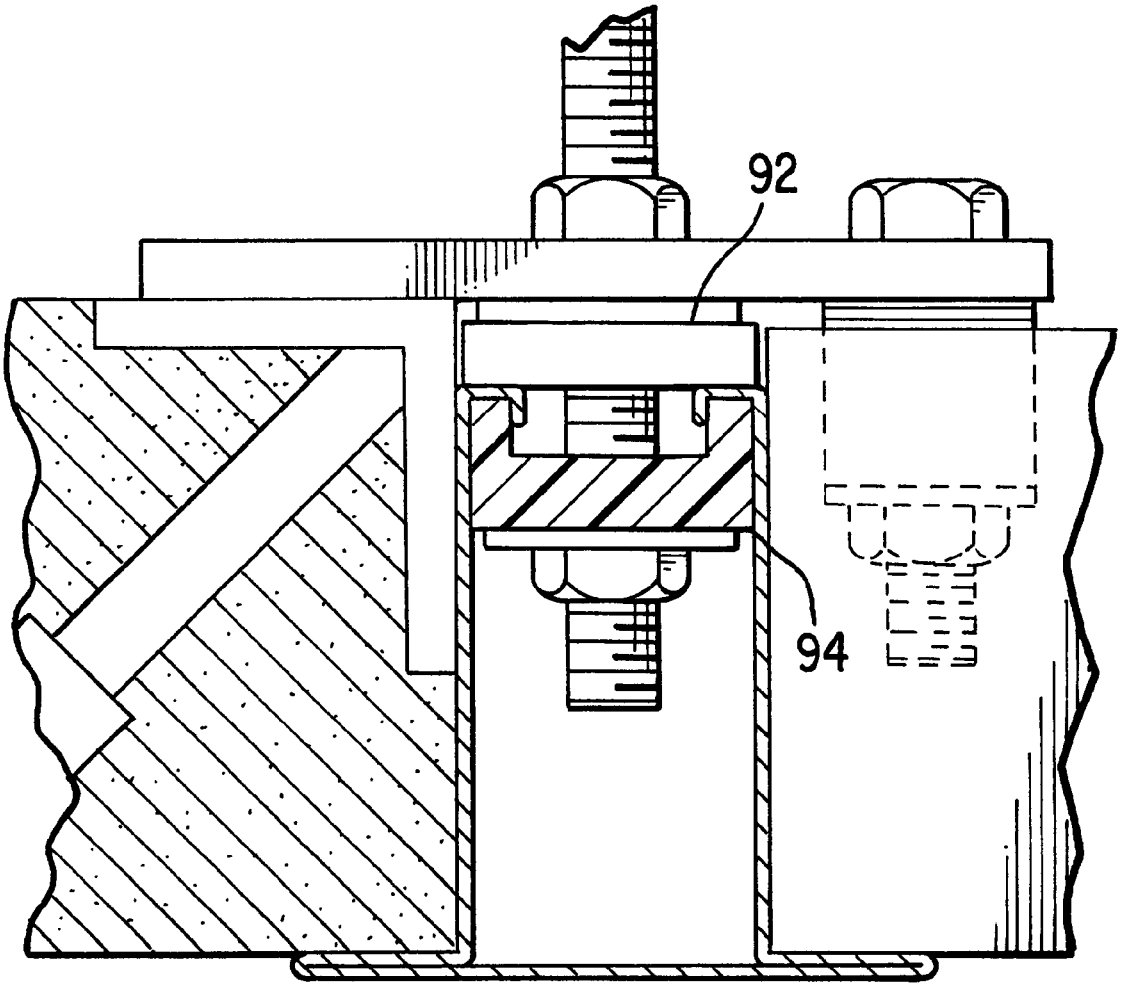
FIG. 11 illustrates a side cut-away view of an alternate embodiment of the energy efficient deck framing system shown in FIG. 3.
Figure 12:
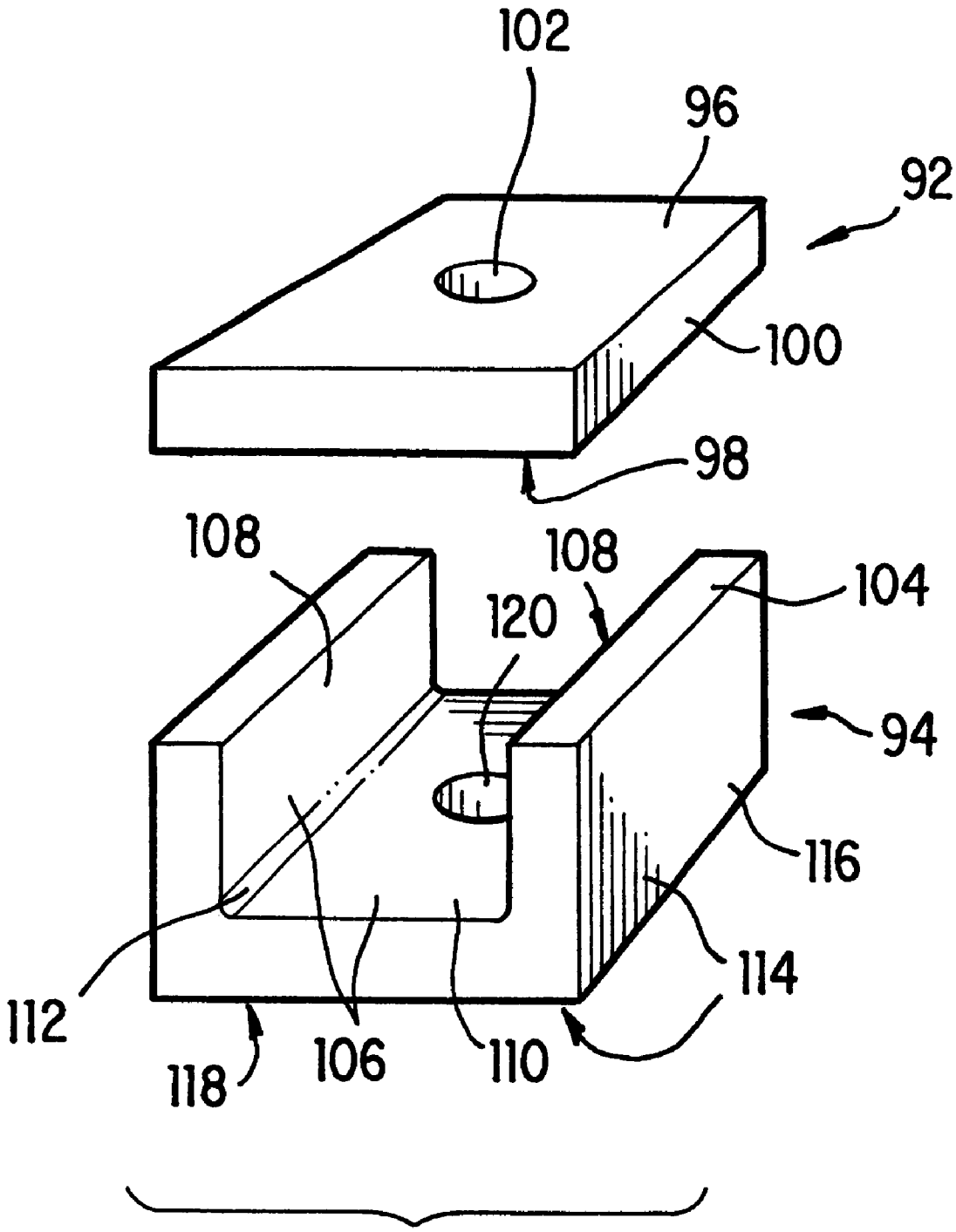
FIG. 12 illustrates a perspective view of an alternate embodiment of the insulating apparatus shown in FIG. 4, showing an insulating retainer clip and an insulating washer adapted for use with the energy efficient deck framing system and method.

Referring now to FIGS. 11 and 12, an alternative embodiment to the insulating subassembly is disclosed. As shown in FIG. 11, a square insulating nut 92 and an alternative design load distribution member or insulating clip 94 are shown. The clip 94 is constructed and arranged to have superior load distributing characteristics.

As shown in FIG. 12, the square insulating nut 92 has a top surface 96, a bottom surface 98 and four sides 100, and is provided with a bolt throughbore 102 sized to accommodate the specific diameter bolt being used to hang the ceiling structure. Both the square insulating nut 92 and the load distributing clip 94 can be constructed of nylon or plastic.

The load distributing clip 94 has top ridges 104 and an interior surface 106 which comprises inwardly facing sides 108 and an upwardly facing top surface 110 or top depressed surface. The sides 108 and the top surface 110 generally meet at a curved boundary portion 112, having a radius of curvature of about one-eighth to one-quarter inch. The boundary portion 112 provides a smoother transition that not only aids the manufacturing process but minimizes shearing stresses that would otherwise contribute to premature breakage of the clip 94.

The clip 94 further has an exterior surface 114 comprising outwardly facing sides 116 and a downwardly facing bottom surface 118. The clip 94 is further provided with a bolt throughbore 120 which is also sized to accommodate the specific diameter bolt being used to hang the ceiling structure.

Figure 13A:
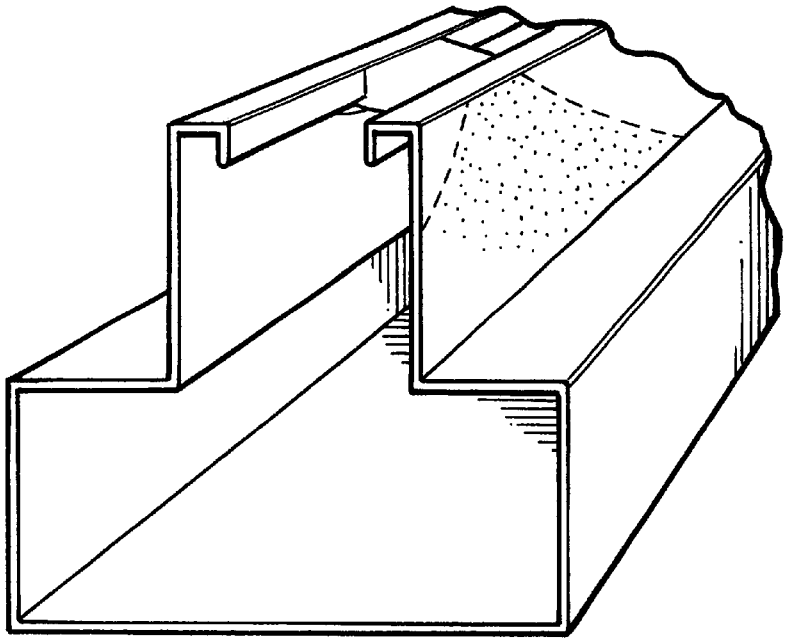
FIG. 13 illustrates a schematic comparison of the load distribution effect expected from the usage of the apparatus shown in FIG. 12 versus more conventional apparatus.
Figure 13B:
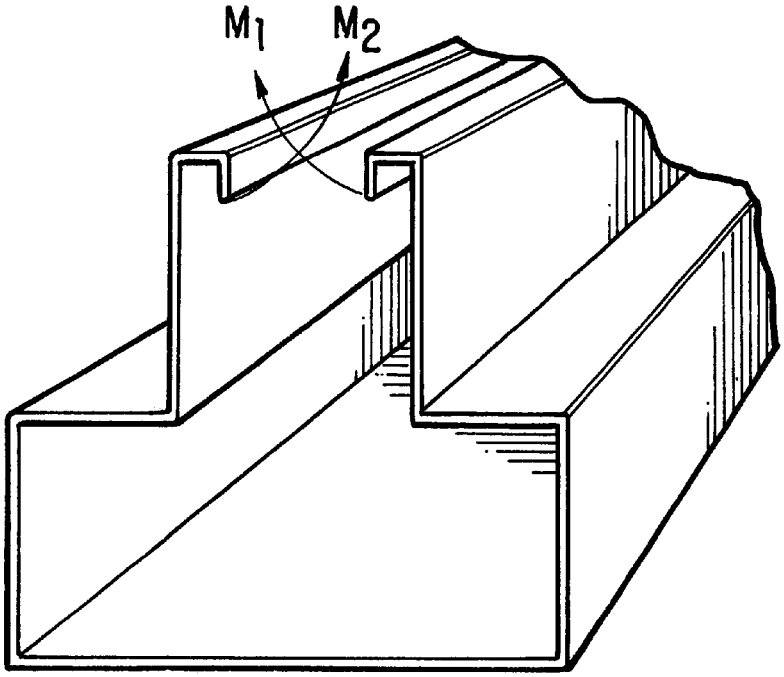

Because the contour of the top ridges 104 of the load distributing clip 94 is selected to complement the contour of the downwardly oriented groove 40 of the framing member, the load transferred from the supporting rod to the framing member is more uniformly distributed. FIG. 13(*a*) is a schematic illustration of the load distributing properties expected by use of the load distributing clip 94, showing a distribution of the load over an area extending approximately 45 degrees outward from the contact points made by the load distributing insulating clip 94 with the top of the framing member. In contrast, without using the load distributing clip 94 of the present invention, a bending moment (as shown in FIG. 13(*b*) by the label M1 and M2)) can be expected in the top flat outer ridge 38, and likewise the inwardly facing vertical surface 36 of the framing member can cut into the clip being utilized. These disadvantages are avoided due to the substantial conformity of the contour of the top ridges 104 of the load distributing clip 94 and the contour of the downwardly oriented groove 40 of the framing member.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a deck framing system having structural framing members that support a deck panel structure, individual deck panels inserted between pairs of the framing members, supporting rods extending downward through the top of the framing members and being provided with (a) a support nut that is located below the top of the framing member and is sized to maintain the framing member in a supported fashion and (b) a secondary nut that is located above the top of the framing member, an insulating subassembly comprising:

an insulating washer disposed about the supporting rod and interposed between the secondary nut and the top of the framing member, and an insulating retainer clip moveable between a deformed position and a substantially non-deformed position and received in the lower portion of the top of the framing member, wherein the insulating retainer clip is constructed and arranged to be securably received within the contours of the framing member and is also constructed and arranged to be releasably mountable on the support nut.

2. An insulating subassembly according to claim 1 wherein the structural framing member has a pair of horizontal flanges, a top, a flat bottom and side walls connecting the horizontal flanges with the top, the top having a pair of outer ridges and a pair of inwardly facing vertical surfaces, the top and a portion of the side wall defining a downwardly oriented groove;

the insulating retainer clip having a top depressed surface and top ridges disposed outwardly therefrom to define upwardly oriented tongues; and the upwardly oriented tongues being constructed and arranged to be received within the downwardly oriented grooves of the structural framing members.

3. An insulating subassembly according to claim 2 wherein the insulating retainer clip is provided with a releasable tab and a retaining tab;

the retaining tab extending horizontally inward from the sides of the retaining clip; and the releasable tab being constructed and arranged to permit manual deformation of the retainer clip from the non-deformed position to the deformed position.

4. An insulating subassembly according to claim 3 wherein the retaining tab and the releasable tab are sized that, in the non-deformed position, the distance therebetween is less than the diameter of the support nut and, in the deformed position, the distance therebetween is greater than the diameter of the support nut.

5. An insulating subassembly according to claim 1 wherein the retainer clip is made of plastic.

6. An insulating subassembly according to claim 1 wherein the retainer clip is made of nylon.

7. For use in a deck framing system having structural framing members that support a deck panel structure, individual deck panels inserted between pairs of the framing members, and supporting rods extending downward through the top of the framing members, the structural framing member having a pair of horizontal flanges, a top, a flat bottom and side walls connecting the horizontal flanges with the top, the top having a pair of outer ridges and a pair of inwardly facing vertical surfaces, the top and a portion of the side wall defining a downwardly oriented groove; a load distributing retainer clip comprising:

a top depressed surface and top ridges disposed outwardly therefrom to define upwardly oriented tongues;

the upwardly oriented tongues being constructed and arranged to be received within the downwardly oriented grooves of the structural framing members and substantially conformed thereto, wherein the load distributing retainer clip is moveable between a deformed position and a substantially non-deformed position;

the upwardly oriented tongues cooperating with the downwardly oriented grooves of the structural framing members so as to be insertable therein in the deformed position and to be securably received therein in the substantially non-deformed position.

8. A load distributing retainer clip according to claim 7 wherein the retainer clip is made of plastic.

9. A load distributing retainer clip according to claim 7 wherein the retainer clip is made of nylon.

* * * * *